US012186680B2

(12) United States Patent
Chen

(10) Patent No.: US 12,186,680 B2
(45) Date of Patent: Jan. 7, 2025

(54) BUBBLE MACHINE

(71) Applicant: SHANTOU HUALONG TOYS CO., LTD, Guangdong (CN)

(72) Inventor: Leyan Chen, Shantou (CN)

(73) Assignee: SHANTOU HUALONG TOYS CO., LTD, Shantou (CN)

( * ) Notice: Subject to any disclaimer, the term of this patent is extended or adjusted under 35 U.S.C. 154(b) by 273 days.

(21) Appl. No.: 17/799,614

(22) PCT Filed: Feb. 5, 2021

(86) PCT No.: PCT/CN2021/075387
§ 371 (c)(1),
(2) Date: Aug. 12, 2022

(87) PCT Pub. No.: WO2022/147874
PCT Pub. Date: Jul. 14, 2022

(65) Prior Publication Data

US 2023/0083190 A1 Mar. 16, 2023

(30) Foreign Application Priority Data

Jan. 11, 2021 (CN) ..... 202120056712.0

(51) Int. Cl.
*A63H 33/28* (2006.01)
*A63H 27/10* (2006.01)

(52) U.S. Cl.
CPC ..... *A63H 33/28* (2013.01); *A63H 27/10* (2013.01); *A63H 2027/1075* (2013.01)

(58) Field of Classification Search
CPC . A63H 33/28; A63H 27/10; A63H 2027/1075
(Continued)

(56) References Cited

U.S. PATENT DOCUMENTS 4,224,760 A * 9/1980 Birdsall ..... A63H 33/28 446/224
4,423,565 A * 1/1984 Bart ..... A63H 33/28 446/16

(Continued)

FOREIGN PATENT DOCUMENTS

CN 2633388 8/2004
CN 2671651 Y 1/2005

(Continued)

OTHER PUBLICATIONS

International Search Report from PCT/CN2021/075387, mailed Sep. 28, 2021, 8 pages with English translation.

*Primary Examiner* — Alexander R Niconovich
(74) *Attorney, Agent, or Firm* — RAY QUINNEY & NEBEKER P.C.; Paul N. Taylor

(57) ABSTRACT

A bubble machine comprising a core and a housing is provided. Part of the core is located in the housing. A bubble outlet of the core is exposed outside the housing, and the housing is flexible and inflatable. The core includes a core body, a bubble outlet head, and an air guiding pipe. The bubble outlet head is provided with a smearing device which is able to smear liquid onto the bubble outlet to form a layer of liquid film. The smearing device comprises a scraper and a rotating strip. A rotating end is arranged in the core body, a rotating shaft of the scraper is connected to the rotating end in the core body by the rotating strip, and the rotating strip is flexible.

7 Claims, 5 Drawing Sheets

(58) Field of Classification Search
USPC ..... 446/15, 16, 18, 21
See application file for complete search history.

(56) References Cited

U.S. PATENT DOCUMENTS

| | | | | |
|---|---|---|---|---|
| 4,655,722 | A * | 4/1987 | Baron | A63H 33/28 239/211 |
| 4,787,875 | A * | 11/1988 | Baron | A63H 33/28 239/289 |
| 4,995,844 | A * | 2/1991 | McNett | A63H 33/28 446/15 |
| 6,241,571 | B1 * | 6/2001 | Chow | A63H 33/28 446/16 |
| 6,572,427 | B1 * | 6/2003 | Thai | A63H 33/28 446/176 |
| 6,616,498 | B1 * | 9/2003 | Thai | A63H 33/28 446/15 |
| 6,682,570 | B2 * | 1/2004 | Thai | A63H 33/28 446/15 |
| 6,860,782 | B2 * | 3/2005 | Hornsby | A63H 33/28 446/15 |
| 6,921,312 | B2 * | 7/2005 | Thai | A63H 33/28 446/176 |
| 7,056,182 | B2 * | 6/2006 | Wan | A63H 33/28 446/15 |
| 7,914,359 | B2 * | 3/2011 | Thai | A63H 33/28 446/15 |
| 8,123,584 | B2 * | 2/2012 | Thai | A63H 33/28 446/16 |
| 8,888,549 | B2 * | 11/2014 | Lo | A63H 33/28 446/16 |
| 9,050,544 | B2 * | 6/2015 | Chen | A63H 33/28 |
| 10,279,279 | B2 * | 5/2019 | Baranoff | A63H 33/005 |
| 10,434,433 | B1 * | 10/2019 | Thai | A63H 33/28 |
| 11,648,487 | B2 * | 5/2023 | Bradley | A42B 1/004 446/15 |
| 11,801,450 | B2 * | 10/2023 | Xiao | A63G 31/12 |
| 11,826,669 | B2 * | 11/2023 | Lo | A63H 29/22 |
| 11,925,878 | B2 * | 3/2024 | Kelly | A63H 33/22 |
| 2007/0037467 | A1 * | 2/2007 | Thai | A63H 33/28 446/15 |
| 2009/0149107 | A1 * | 6/2009 | Thai | A63H 33/28 446/15 |
| 2014/0141688 | A1 * | 5/2014 | Kelly | A63H 33/28 446/15 |
| 2014/0364032 | A1 * | 12/2014 | Kelly | A63H 33/28 446/15 |
| 2019/0192989 | A1 * | 6/2019 | Kelly | A63H 33/28 |
| 2021/0379503 | A1 * | 12/2021 | Kelly | A63H 33/22 |
| 2022/0054951 | A1 * | 2/2022 | Bradley | A63H 33/28 |
| 2023/0113367 | A1 * | 4/2023 | Wang | A63H 27/10 446/15 |
| 2023/0277953 | A1 * | 9/2023 | Kelly | A63H 33/22 446/15 |
| 2024/0058715 | A1 * | 2/2024 | Kelly | A63H 27/10 |

FOREIGN PATENT DOCUMENTS

| | | | |
|---|---|---|---|
| CN | 2683224 | Y | 3/2005 |
| CN | 203954694 | U | 11/2014 |
| CN | 108525329 | A | 9/2018 |
| CN | 212235988 | U | 12/2020 |

* cited by examiner

BUBBLE MACHINE

CROSS REFERENCE TO RELATED APPLICATION

This application is a U.S. Nationalization of PCT Application Number PCT/CN2021/07538, filed on Feb. 5, 2021, which claims the benefit and priority of Chinese Patent Application No. 202120056712.0 filed on Jan. 11, 2021, the disclosures of which are incorporated by reference herein in their entireties as part of the present application.

TECHNICAL FIELD

The present disclosure relates to the technical field of children's toys, and in particular relates to bubble machine.

BACKGROUND ART

The bubble toy is a children's toy capable of blowing out bubbles and is popular with children. Bubble outlet heads in existing bubble machines are all integrated on the bodies of cores, and housings of the existing bubble machines are all hard housings. However, the hard housings are unable to shrink during storage and transportation, a novel bubble machine is therefore urgently needed.

SUMMARY

The objective of the present disclosure is to provide bubble machine to solve above problems in the prior art which making the bubble machine variable in volume.

To achieve the objective, the present disclosure provides the following solutions:

A bubble machine is provided by the present disclosure, comprising a core and a housing, wherein part of the core is located in the housing, the housing is arranged on the core, a bubble outlet of the core is exposed outside the housing, and the housing is a flexible inflatable housing.

Preferably, the flexible inflatable housing is an inflatable balloon.

Preferably, the core comprises a core body, a bubble outlet head, and an air guiding pipe, wherein the bubble outlet head is provided with a liquid inlet and a liquid returning port; the core body is provided with an air outlet, and air can be discharged from the air outlet. Both ends of the air guiding pipe are connected to and communicated with one end of the bubble outlet head and the air outlet, respectively. The bubble outlet head is hollow, and the other end of the bubble outlet head is provided with the bubble outlet. The air guiding pipe is located in the housing, and the housing is provided with a first opening and a second opening. The bubble outlet corresponds to the first opening, and the second opening is hermetically connected to the air guiding pipe or the core body.

Preferably, the bubble outlet head is provided with a smearing device which can smear liquid onto the bubble outlet to form a layer of liquid film.

Preferably, the smearing device comprises a scraper and a rotating strip. The rotating end is arranged in the core body, and the rotating shaft of the scraper is connected to the rotating end in the core body by the rotating strip. The rotating strip is flexible, and the rotating end rotates to drive the scraper to rotate by the rotating strip.

Preferably, the air guiding pipe can be deformed.

Preferably, part of the air guiding pipe is in a corrugated pipe shape to form a deformation part, and the deformation part can stretch out and draw back and can be freely bent in any direction.

Preferably, the rotating strip is made of flexible plastic.

Preferably, the rotating strip is located in the air guiding pipe.

Preferably, the rotating shaft of the scraper is coaxial with the central axis of the bubble outlet on the bubble outlet head, and the bubble outlet is further provided with a support for supporting the scraper.

Compared with the prior art, the present disclosure has the following technical effects:

A bubble machine is provided by the present disclosure, and the bubble machine comprises a core and a housing, wherein the housing is a flexible inflatable housing. The housing undergoes shrinkage deformation after deflated, and the housing expands to present its original shape to please the children after inflated. Therefore, the volume of the bubble machine provided by the present disclosure can be increased or reduced. During storage and transportation, gas in the housing can be released to make the volume of the housing smaller for transportation and storage. When the children play with the bubble machine, the housing is inflated to restore its original shape to please the children.

BRIEF DESCRIPTION OF THE DRAWINGS

To describe the technical solutions in the embodiments of the present disclosure or in the prior art more clearly, the following briefly will introduce the accompanying drawings required for describing the embodiments. Apparently, the accompanying drawings in the following description show merely some embodiments of the present disclosure, and a person of ordinary skill in the art may still derive other drawings based on these accompanying drawings without creative efforts.

Figure 1:
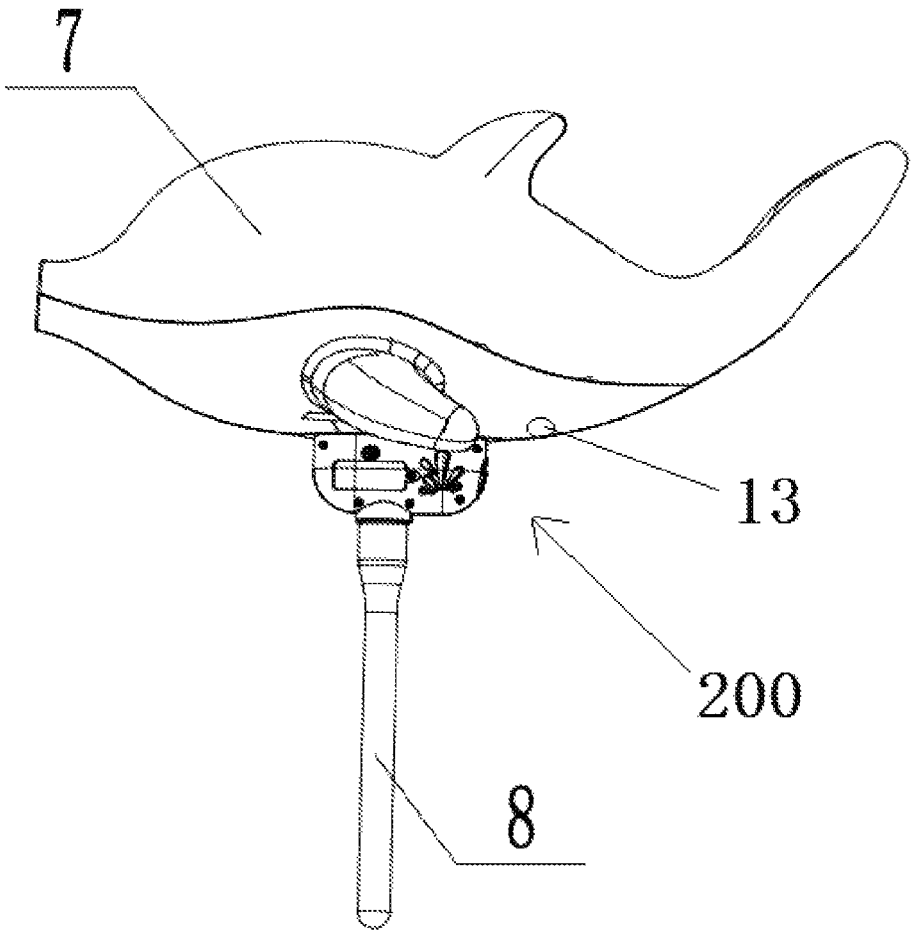
FIG. 1 is a front view of a bubble machine provided by the present disclosure.

In the drawings: 1—core body; 2—bubble outlet head; 3—air guiding pipe; 4—rotating strip; 5—scraper; 6—smearing device; 7—housing; 8—supporting handle; 9—bubble outlet; 10—liquid inlet; 11—air outlet; 12—liquid return port; 13—inflation port; 31—deformation part; 100—core; 200—bubble machine.

DETAILED DESCRIPTION OF THE EMBODIMENTS

The following will clearly and completely describe the technical solutions in the embodiments of the present disclosure with reference to the accompanying drawings in the embodiments of the present disclosure. Apparently, the described embodiments are merely part rather than all of the embodiments of the present disclosure. All other embodiments obtained by a person of ordinary skill in the art based on the embodiments of the present disclosure without creative efforts shall fall within the scope of the present disclosure.

The objective of the present disclosure is to provide bubble machine to solve the problems in the prior art which making the bubble machine variable in volume.

To make the objectives, features and advantages described above of the present disclosure more apparent and understandable, the present disclosure is further described in detail below with reference to the accompanying drawings and specific embodiments.

Figure 2:
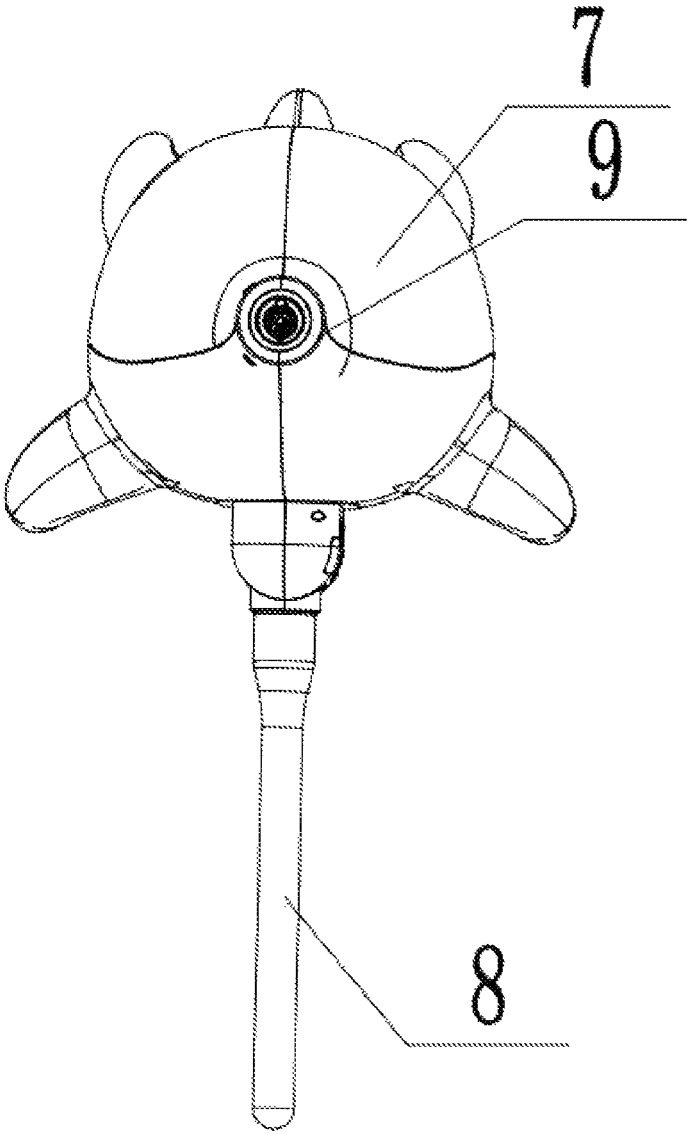
FIG. 2 is a left view of FIG. 1.
Figure 3:
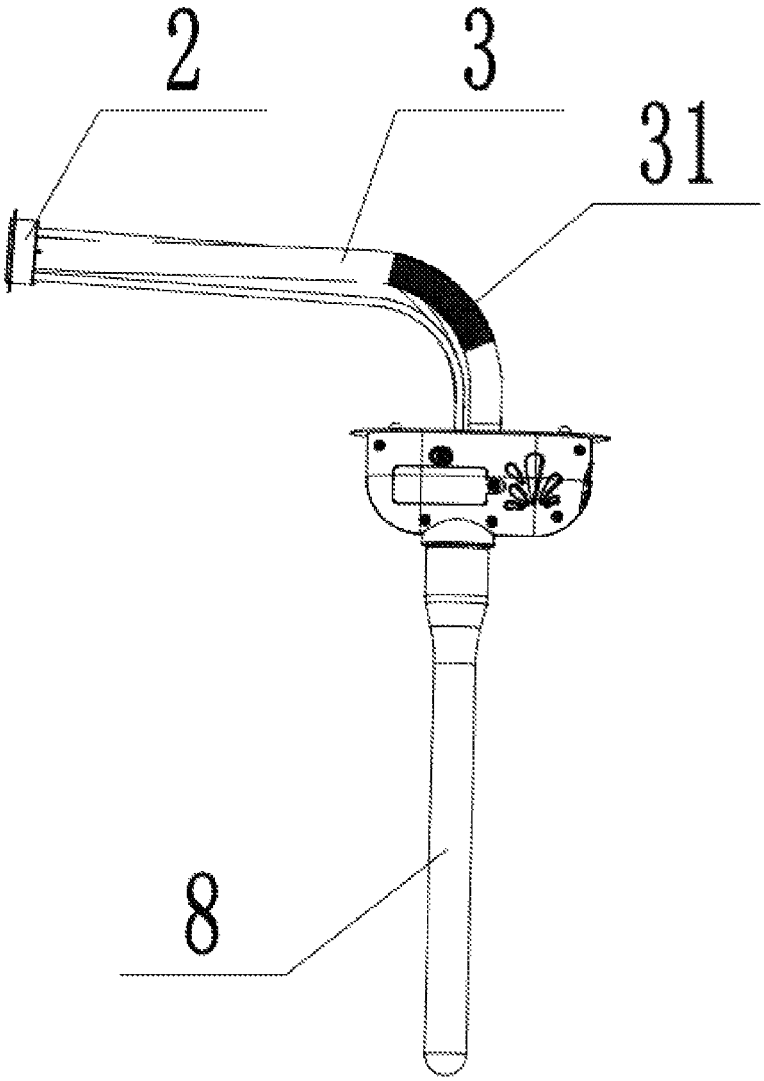
FIG. 3 is a structure schematic diagram of a bubble machine without a housing provided by the present disclosure.
Figure 4:
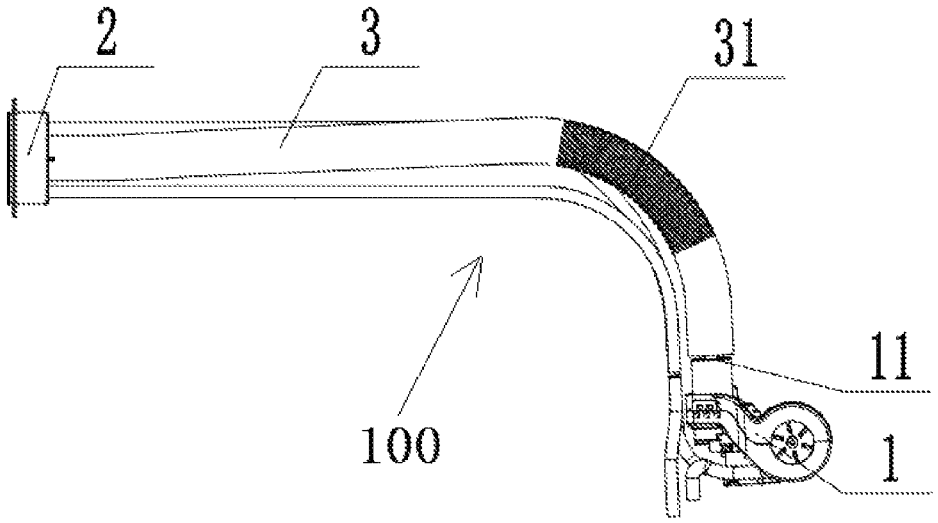
FIG. 4 is a structure schematic diagram of a core provided by the present disclosure.
Figure 5:
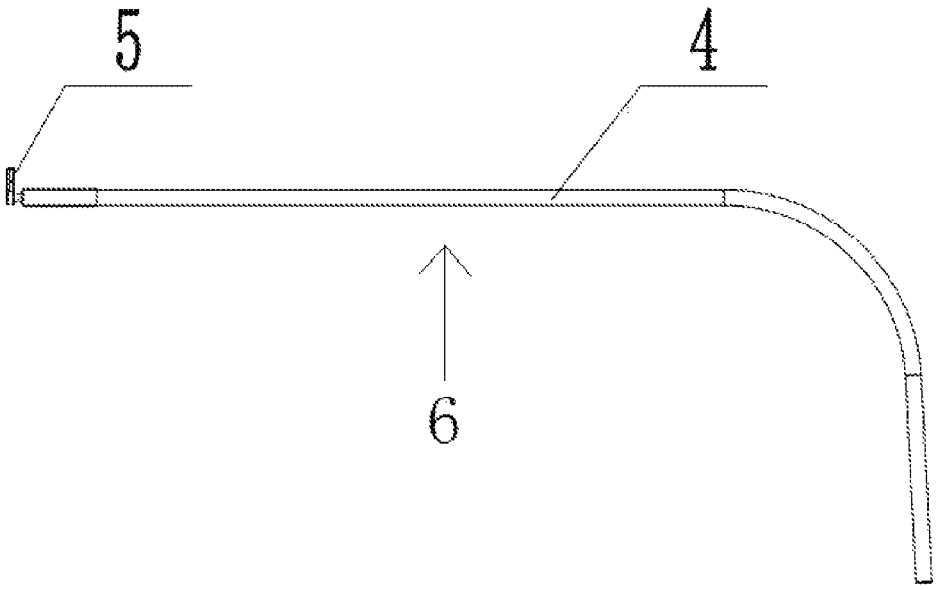
FIG. 5 is a structure schematic diagram of a scraper and a rotating strip in a core provided by the present disclosure.
Figure 6:
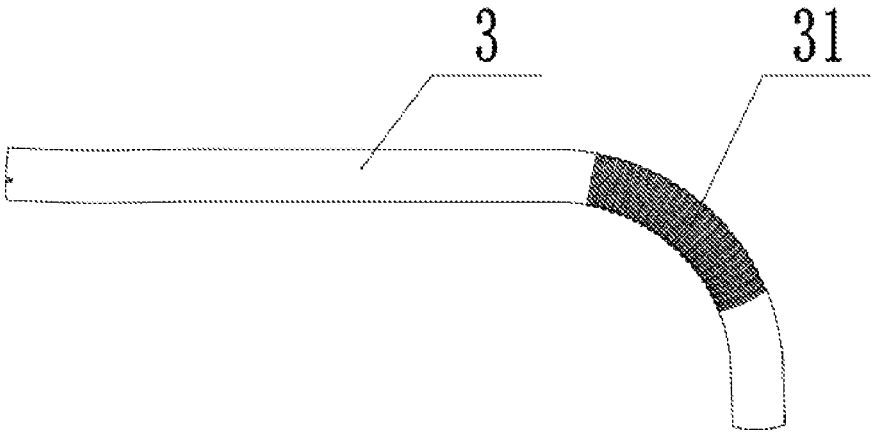
FIG. 6 is a structure schematic diagram of an air guiding pipe in a core provided by the present disclosure.
Figure 7:
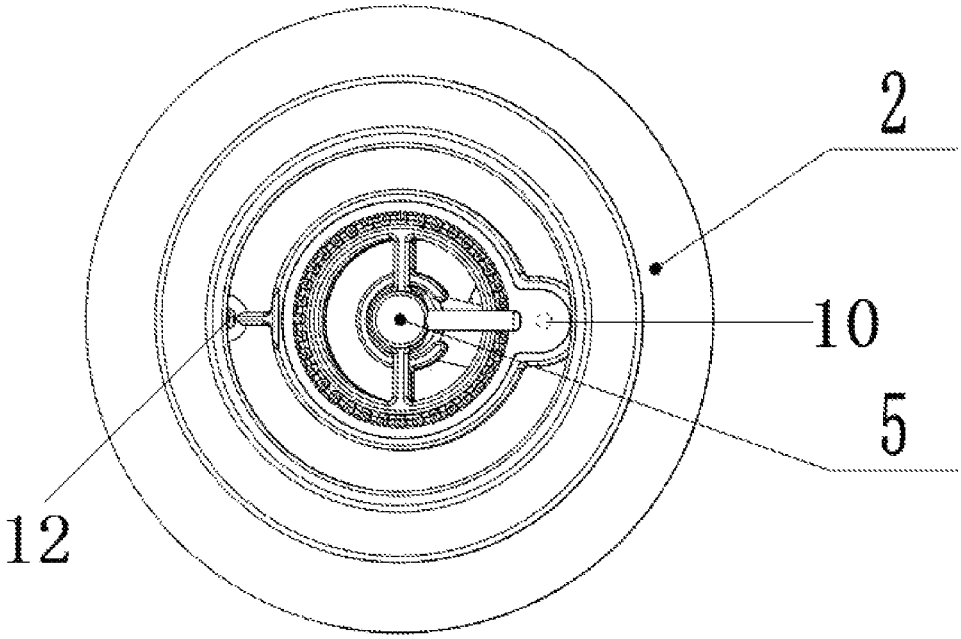
FIG. 7 is a structure schematic diagram of a bubble outlet head in a core provided by the present disclosure.

A bubble machine 200 is provided by the present disclosure, as shown in FIG. 1 to FIG. 7, the bubble machine 200 comprises a core 100 and a housing 7, wherein part of the core 100 is located in the housing 7, the housing 7 is arranged on the core 100, a bubble outlet 9 of the core 100 is exposed to the housing 7, and the housing 7 is a flexible inflatable housing 7. The shape of the housing 7 is ornamental in general. The shape of the housing 7 can be selected as a shark shape, a penguin shape and other shapes preferred by children;

Wherein, the housing 7 may undergo shrinkage deformation after deflated, and the housing 7 may expand to present its original shape to please the children after inflated. Therefore, the volume of the bubble machine provided by the present disclosure can be increased or reduced. During storage and transportation, gas in the housing 7 can be released to make the volume of the housing smaller for transportation and storage. When the children play with the bubble machine, the housing is inflated to restore its original shape to please the children.

Furthermore, the flexible inflatable housing 7 is an inflatable balloon, the inflatable balloon is provided with an inflation port 13, and the balloon is flexible and shrinkable. Therefore, the volume of the housing 7 made of the balloon can be increased or reduced. The user can change the size of the shape of the housing by inflating the balloon based on his/her own demands, and the gas in the balloon can be completely released when the bubble machine needs to be transported or stored.

Furthermore, the core 100 comprises a core body 1, a bubble outlet head 2, and an air guiding pipe 3. The bubble outlet head 2 is provided with a liquid inlet 10 and a liquid return port 12; the core body 1 is provided with an air outlet 11, and air can be discharged from the air outlet 11. Both ends of the air guiding pipe 3 are connected to and communicated with one end of the bubble outlet head 2 and the air outlet 11, respectively. The bubble outlet head 2 is hollow, and the other end of the bubble outlet head 2 is provided with the bubble outlet 9. The air guiding pipe 3 is located in the housing 7, and the housing 7 is provided with a first opening and a second opening. The bubble outlet 9 corresponds to the first opening, and the second opening is hermetically connected to the air guiding pipe 3 or the core body 1. The first opening is hermetically connected to the bubble outlet head 2 to prevent air leakage. One end, away from the housing 7, of the core body 1 is provided with a supporting handle 8 which is hollow and can serve as a liquid storage chamber, and the user can play with the bubble machine by holding the supporting handle 8.

Furthermore, the bubble outlet head 2 is provided with a smearing device 6 which can smear liquid onto the bubble outlet 9 to form a layer of liquid film.

Furthermore, the smearing device 6 comprises a scraper 5 and a rotating strip 4. A rotating end is arranged in the core body 1, and the rotating shaft of the scraper 5 is connected to the rotating end in the core body 1 by means of the rotating strip 4. The rotating strip 4 is flexible and can be bent to deform; and the rotating strip 4 has a certain rigidity. The rotating end rotates to drive the scraper 5 to rotate by means of the rotating strip 4, such that a driving device in the core body 1 can remotely control rotation of the scraper 5.

Furthermore, in order to further enhance the deformation ability of the device, the air guiding pipe 3 is set as a hose, such that the air guiding pipe 3 can be deformed, and the volume of the device can be further shrunk.

Furthermore, part of the air guiding pipe 3 is in a corrugated pipe shape and may be a hard pipe or a flexible pipe to form a deformation part 31. The deformation part 31 can stretch out and draw back and can be freely bent in any direction. The deformation part 31 is provided to make the air guiding pipe 3 have a shrinkage function to adapt to the change of the volume of the housing 7.

Furthermore, the rotating strip 4 is made of flexible plastic, preferably a square strip.

Furthermore, the rotating strip 4 is located in the air guiding pipe 3.

Furthermore, the rotating shaft of the scraper 5 is coaxial with the central axis of the bubble outlet 9 on the bubble outlet head 2, and the bubble outlet 9 is further provided with a support for supporting the scraper 5.

In accordance with the present disclosure, specific examples are used for illustration of the principles and embodiments of the present disclosure. The description of above embodiments is merely used to help illustrate the method and its core principles of the present disclosure. In addition, a person of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A bubble machine, comprising:

a core comprising:

a core body provided with an air outlet, wherein air is dischargeable from the air outlet;

a bubble outlet head provided with a liquid inlet and a liquid return port, and being hollow; and an air guiding pipe, wherein the air guiding pipe has two ends that are connected to and in communication with one end of the bubble outlet head and the air outlet, respectively; and a housing arranged on the core, being a flexible inflatable housing and provided with a first opening and a second opening, wherein part of the core is located in the housing;

wherein a bubble outlet of the core is exposed outside the housing, and the housing is a flexible inflatable housing;

wherein an other end of the bubble outlet head is provided with the bubble outlet;

wherein the air guiding pipe is located in the housing;

wherein the bubble outlet corresponds to the first opening, and the second opening is hermetically connected to the air guiding pipe or the core body;

wherein the bubble outlet head is provided with a smearing device which is able to smear liquid onto the bubble outlet to form a layer of liquid film, the smearing device comprising:

a scraper; and a rotating strip being flexible, wherein a rotating end is arranged in the core body; and a rotating shaft of the scraper is connected to the rotating end in the core body by the rotating strip, wherein the rotating end rotates to drive the scraper to rotate by the rotating strip.

2. The bubble machine according to claim 1, wherein the flexible inflatable housing is an inflatable balloon.

3. The bubble machine according to claim 1, wherein the air guiding pipe is deformable.

4. The bubble machine according to claim 3, wherein the rotating strip is made of flexible plastic.

5. The bubble machine according to claim 1, wherein part of the air guiding pipe is in a corrugated pipe shape to form a deformation part, and the deformation part is able to stretch out and draw back and is able to bend freely in any direction.

6. The bubble machine according to claim 1, wherein the rotating strip is located in the air guiding pipe.

7. The bubble machine according to claim 1, wherein the rotating shaft of the scraper is coaxial with a central axis of the bubble outlet on the bubble outlet head, and the bubble outlet is further provided with a support for supporting the scraper.

* * * * *